US007708503B2

(12) United States Patent
Kohel et al.

(10) Patent No.: US 7,708,503 B2
(45) Date of Patent: May 4, 2010

(54) EXTRUDED PLASTIC NETTING FOR USE IN EROSION CONTROL, MULCH STABILIZATION, AND TURF REINFORCEMENT

(75) Inventors: Bartley J. Kohel, Oakdale, MN (US); Keith E. Misukanis, Eagan, MN (US); Christopher P. Hakanson, Woodbury, MN (US)

(73) Assignee: Conwed Plastics LLC, Minneapolis, MN (US)

( * ) Notice: Subject to any disclaimer, the term of this patent is extended or adjusted under 35 U.S.C. 154(b) by 0 days.

(21) Appl. No.: 11/675,916

(22) Filed: Feb. 16, 2007

(65) Prior Publication Data

US 2007/0196185 A1 Aug. 23, 2007

Related U.S. Application Data

(60) Provisional application No. 60/775,237, filed on Feb. 20, 2006.

(51) Int. Cl.
*E02D 17/20* (2006.01)

(52) U.S. Cl. ..... 405/302.7; 405/302.6; 405/302.4

(58) Field of Classification Search ..... 405/302.7, 405/302.6, 302.4
See application file for complete search history.

(56) References Cited

U.S. PATENT DOCUMENTS

| | | | | |
|---|---|---|---|---|
| 3,700,521 | A | 10/1972 | Gaffney | |
| 3,723,218 | A | 3/1973 | Gaffney | |
| 3,767,353 | A | 10/1973 | Gaffney | |
| 4,123,491 | A | 10/1978 | Larsen | |
| 4,152,479 | A | 5/1979 | Larsen | |
| 4,190,692 | A | 2/1980 | Larsen | |
| 4,610,568 | A * | 9/1986 | Koerner | 405/302.7 |
| 5,182,162 | A | 1/1993 | Andrusko | |
| 5,249,893 | A | 10/1993 | Romanek et al. | |
| 5,358,356 | A | 10/1994 | Romanek et al. | |
| 5,735,982 | A | 4/1998 | Prunty et al. | |
| 5,786,281 | A | 7/1998 | Prunty et al. | |
| 5,849,645 | A | 12/1998 | Lancaster | |
| 5,851,089 | A * | 12/1998 | Beretta | 405/302.7 |
| 6,135,672 | A * | 10/2000 | Davidson | 405/302.7 |
| 6,280,676 | B1 * | 8/2001 | Cederblad | 264/291 |
| 6,855,650 | B1 | 2/2005 | Bohannon, Jr. | |
| 6,929,425 | B1 | 8/2005 | Kimberlin et al. | |
| 7,029,208 | B1 * | 4/2006 | Santha | 405/302.7 |
| 2005/0183329 | A1 | 8/2005 | Cederblad et al. | |
| 2005/0217173 | A1 | 10/2005 | Walraevens et al. | |

* cited by examiner

*Primary Examiner*—Frederick L Lagman
(74) *Attorney, Agent, or Firm*—Brooks Kushman P.C.

(57) ABSTRACT

In at least certain embodiments of the present invention, the present invention provides a plastic netting for use in various erosion control netting assembles. In at least one embodiment, the assembly comprises a first extruded plastic net, a second extruded plastic net secured to the first net, and a fiber matrix disposed between the nets. In at least another embodiment, the assembly comprises a first extruded plastic net, and a fiber matrix secured to and/or under the netting. In at least another embodiment, the net serves as a mulch control netting when secured to the ground over a mulch material. In yet another embodiment, the net serves as a turf reinforcement. In at least one embodiment, the net comprises a plurality of openings sufficiently sized, to enable small animals to traverse or weave through the erosion control netting assembly without getting trapped in the openings.

27 Claims, 4 Drawing Sheets

EXTRUDED PLASTIC NETTING FOR USE IN EROSION CONTROL, MULCH STABILIZATION, AND TURF REINFORCEMENT

CROSS-REFERENCE TO RELATED APPLICATIONS

This application claims the benefit of U.S. provisional application Ser. No. 60/775,237 filed Feb. 20, 2006, which is incorporated herein by reference.

BACKGROUND OF THE INVENTION

1. Field of the Invention

The present invention relates to an extruded netting for use in erosion control net, mulch stabilization, and turf reinforcement which can be useful in reducing potential for animal entrapment and/or enhancing soil stabilization.

2. Background Art

The continuous extrusion of plastic netting started in the 1950s. Extruded netting is netting in which the strands are extruded from a die, the joints therebetween being formed either within the die or immediately outside the die. A variety of configurations are known, such as square, diamond, twill, etc. Some of the more common materials used to prepare extruded netting are polypropylene, polyethylene (particularly linear low grades, and ethylene copolymers), nylon, polybutylene, and blends thereof.

Currently, the extrusion process of choice for manufacturing plastic nets is one in which individual plastic strands are extruded in an interconnecting network to provide the net-like structure. Typically, either a rotary or a reciprocating extrusion process is employed. Methods for practicing the reciprocating technique are well known. For instance, U.S. Pat. Nos. 3,700,521; 3,767,353; 3,723,218; 4,123,491; 4,152,479 and 4,190,692 show apparatus and methods for making nets by the continuous extrusion of individual plastic strands. The disclosures of the above-mentioned issued patents are incorporated by reference into the present application.

Plastic netting has found a number of uses in commerce. For example, these nets have found use as breathable packaging netting for produce and other perishable items, agricultural netting, such as bird and hail guard netting, and netting for industrial, filtration, and home furnishings applications.

Netting has also found use in certain composites. In such composites the netting is laminated or otherwise combined with one or more fabric overlays. Chief among such uses and composites are fabrics for disposable diapers, incontinent briefs, training pants, bandages, dressings, diaper holders and liners, feminine hygiene garments, medical gowns, medical drapes, mattress pads, blankets, sheets, clothing, consumer wipes and other like products, such as building and construction composites.

One specific use of plastic netting is to serve as at least one of the outer layers or a structural support for erosion control applications, such as erosion control blankets. Erosion control blankets are well known and are used to inhibit soil degradation and erosion due to water-runoff in surface areas prone to such environmental destruction such as highway embankments, water drainage ditches, channels, and landscaping.

Another use for the plastic netting is to serve as mulch control netting. These nettings are rolled out over the top of a seeded or mulched area and are staked into place in order to keep the mulch or seed into place, providing erosion control protection under the applied treatment. Typical mulch materials include straw and hay. This type of application is used where the mulch material may benefit from external stabilization, but does not demand the superior protection that is obtained through the use of an erosion control blanket.

Yet another use for the plastic netting is to serve as turf reinforcement either in the form of a field net or a turf wrap. Field net is a durable mesh that is laid down on a seedbed usually prior to or just after seeding to facilitate grass root consolidation. The netting helps allow the grass seedlings to germinate and grow while the roots intertwine with the mesh to create a reinforced uniform structure. Because of the stronger system, growers can usually harvest earlier with generally thinner slabs maximizing land utilization. Turf wrap is applied during harvest to reinforce large rolls of turf. The rolls are wrapped to protect the turf during harvest, transportation and installation to minimize turf loss and maintain roll quality. Turf wrap can remain on the rolls or be removed during installation based on customer needs.

There are many varieties of erosion control blankets that are used today. One such variety comprises two opposed netting materials, such as plastic netting, which sandwiches a loose fibrous material. Such loose fibrous materials are well known and can comprise natural fills such as straw, coconut, coir, wood fiber and excelsior as well as synthetic types of fills such as materials made of polyethylene, polypropylene, polyester, polyvinylchloride, and nylon fibers. Another type of erosion control blanket comprises a loose fibrous fill material having a netting material embedded therein.

One drawback that has been discovered in using netting in erosion control assemblies, such as erosion control blankets and as a mulch control net, is that small animals such as snakes, lizards, and frogs tend to get stuck in the netting openings as they try to weave through the openings. When these animals become trapped, they can cause harm to the erosion control assembly and/or to themselves. For instance, the animals can damage the erosion control assembly and/or dislodge the erosion control assembly from its desired location while trying to dislodge themselves from the netting. Moreover, the animal could perish while trapped in the netting either by not being able to get to food and/or water or by being easy prey for other animals.

Accordingly, it would be advantageous to provide a netting for use in an erosion control blanket and other like erosion control applications, such as mulch control, that would help reduce the incidents of trapped animals in the netting.

SUMMARY OF THE INVENTION

According to at least one aspect of the invention, an erosion control netting assembly is provided.

In accordance with the present invention, the erosion control netting assembly may take many various forms of terrain stabilization assemblies. For instance, the erosion control assembly/terrain stabilization assembly may take the form of an erosion control blanket, a mulch control netting and/or assembly, turf reinforcement netting, and the like. It should also be readily understood that these specific erosion control assemblies may take various forms. For instance, the erosion control blanket/terrain stabilization assembly could have fill material sandwiched between two similar sized nets, fill material sandwiched between two different sized nets, a net over and secured to fill material, or a net over fill material or seed such that the net and fill are staked or otherwise secured to the ground. It should be understood that erosion control assemblies and terrain stabilization assemblies can be used interchangeably.

In certain embodiments, it should be understood that the fiber matrix could be fiber, fill, seed and/or mulch or the like.

In at least one embodiment, the present invention provides an erosion control netting assembly comprising a first extruded plastic net, a second extruded plastic net secured to the first net, and a fiber matrix disposed between the nets. In at least this embodiment, each of the first and second nets comprises a plurality of generally first direction members spaced apart from each other and a plurality of generally second direction members spaced apart from each other and attached to the generally first direction members to form joints at the intersections of the generally first direction members and the generally second direction members. In at least this embodiment, the first direction members have a first strand count/inch and the second direction members have a second strand count/inch, greater than or substantially equal to the first strand count/inch. In at least this embodiment, adjacent generally first direction members and intersecting adjacent generally second direction members cooperate to form openings in the first net that are engineered, or sufficiently sized, to enable small animals to traverse or weave through the erosion control netting assembly without getting trapped in the openings.

In at least another embodiment, the present invention provides an extruded plastic net for use as in a terrain stabilization assembly, such as an erosion control netting, mulch stabilization netting, or a turf reinforcement netting, wherein the net is secured to, or staked or otherwise secured over, a fibrous matrix, fill material, mulch, seed, turf, or the like.

In yet at least another embodiment, the present invention provides an erosion control netting assembly comprising a first extruded plastic net, and a fiber matrix secured to the net. In at least this embodiment, the net comprises a plurality of generally first direction members spaced apart from each other and a plurality of generally second direction members spaced apart from each other and attached to the generally first direction members to form joints at the intersections of the generally first direction members and the generally second direction members to form openings having a first direction mesh size (FDMS) to second direction mesh size (SDMS) ratio (FDMS/SDMS) of at least 2.5 or a first direction mesh size (FDMS) and a second direction mesh size (SDMS) of at least 2.4 inches per strand, wherein the first direction members having a first strand count/inch and the second direction members having a second strand count/inch, greater than or substantially equal to the first strand count/inch.

In still yet at least another embodiment, the present invention provides an erosion control netting assembly comprising a first extruded plastic net, a second extruded plastic net spaced from and optionally secured to the first net, and a fiber matrix disposed between the nets, wherein at least one of the nets comprises a plurality of generally first direction members spaced apart from each other and a plurality of generally second direction members spaced apart from each other and attached to the generally first direction members to form joints at the intersections of the generally first direction members and the generally second direction members to form openings having a first direction mesh size (FDMS) to second direction mesh size (SDMS) ratio (FDMS/SDMS) of at least 2.5 or a first direction mesh size (FDMS) and a second direction mesh size (SDMS) of at least 2.4 inches per strand, wherein the first direction members having a first strand count/inch and the second direction members having a second strand count/inch, greater than or substantially equal to the first strand count/inch.

DETAILED DESCRIPTION OF THE PREFERRED EMBODIMENTS

Reference will now be made in detail to presently preferred compositions, embodiments and methods of the present invention, which constitute the best modes of practicing the invention presently known to the inventors. The Figures are not necessarily to scale. However, it is to be understood that the disclosed embodiments are merely exemplary of the invention that may be embodied in various and alternative forms. Therefore, specific details disclosed herein are not to be interpreted as limiting, but merely as a representative basis for any aspect of the invention and/or as a representative basis for teaching one skilled in the art to variously employ the present invention.

Except in the examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of," and ratio values are by weight; the term "polymer" includes "oligomer," "copolymer," "terpolymer," and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; the first definition of an acronym or other abbreviation applies to all subsequent uses herein of the same abbreviation and applies mutatis mutandis to normal grammatical variations of the initially defined abbreviation; and, unless expressly stated to the contrary, measurement of a property is determined by the same technique as previously or later referenced for the same property.

Figure 1:
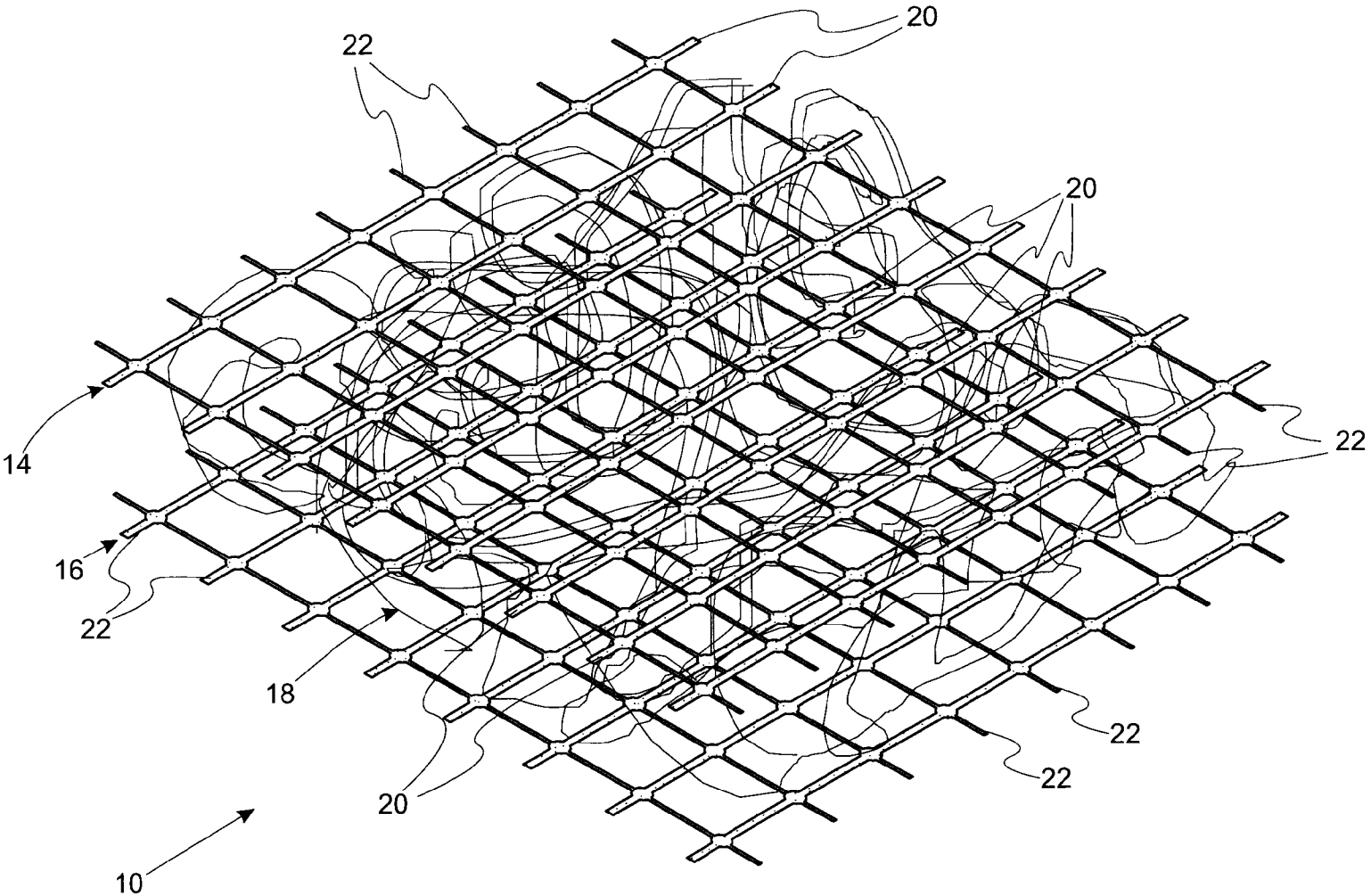
FIG. 1 is a cut-away perspective view of an embodiment of an erosion control netting assembly of the present invention.

Referring to FIG. 1, a perspective view of an exemplary erosion control netting assembly 10 is illustrated. In the illustrated embodiment, the exemplary erosion control netting assembly 10 includes two spaced apart plastic nets 14 and 16, a top net 14 and a bottom net 16. The illustrated exemplary erosion control netting assembly 10 further includes a fibrous matrix 18, i.e., fill material, disposed between the nets 14 and 16.

The fibrous matrix 18 may be made of any suitable fibrous material and may comprise any suitable natural fibrous material, any suitable synthetic fibrous material, and suitable blends thereof. Suitable fibrous matrix are well known. For example, U.S. Pat. Nos. 6,929,425, 6,855,650, 5,849,645, 5,786,281, 5,735,982, 5,358,356, 5,249,893, and 5,182,162, which are incorporated herein by reference, disclose suitable fibrous matrixes. Some examples of suitable natural fibrous materials included, but are not necessarily limited to, recycled paper or fiberized waste paper, wood fibers or excelsior, straw or other naturally fibrous materials such as coconut husks and coir.

Some examples of suitable synthetic fibrous materials include, but are not necessarily limited to, polyethylene, polypropylene, polyester, polyvinylchloride, and nylon fibers. The size and thickness of the fibrous matrix 18 may vary as needed. In at least one embodiment the matrix 18 has a thickness of 0.08 to 2.5 inches.

In at least one embodiment, the nets 14 and 16 may be secured to the matrix 18 and each other by any suitable securing technique such as by weaving, stitch bonding, gluing or other fastening systems.

Figure 3:
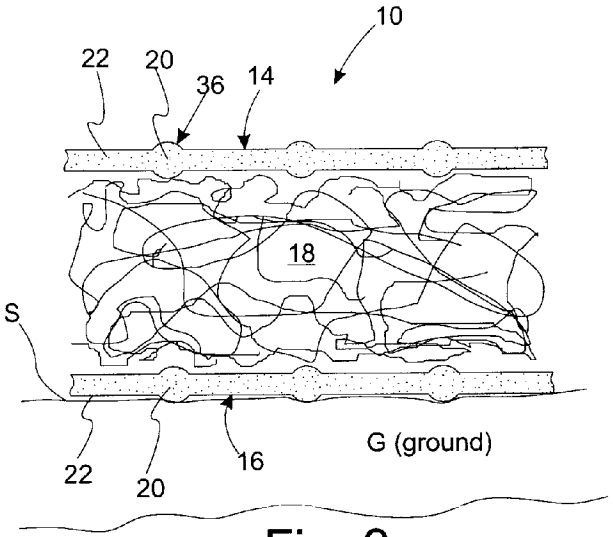
FIG. 3 is a side view of the erosion control netting assembly of FIG. 1 in an exemplary use.
Figure 4:
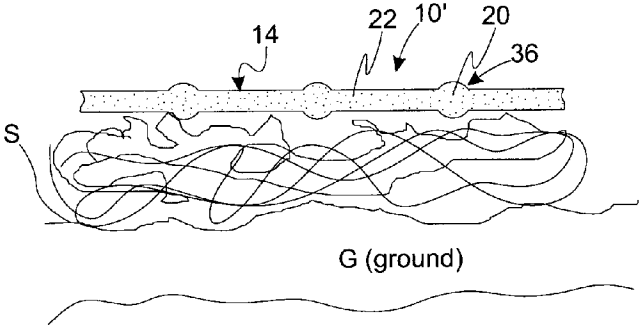
FIG. 4 is a side view of another embodiment of an erosion control netting assembly of the present invention.

In another embodiment, as best illustrated in FIG. 4, the assembly 10' has only one net 14. Assemblies 10' of this type can be particularly useful for mulch control applications, turf reinforcement, and certain erosion control blankets. In these applications, the net 14 can be secured over the mulch, seed, or fill, schematically illustrated as 18, by any suitable means, such as by stakes and/or staples. Net 14 in this embodiment has the same construction as top net 14 shown in FIGS. 1 and 3.

Figure 5:
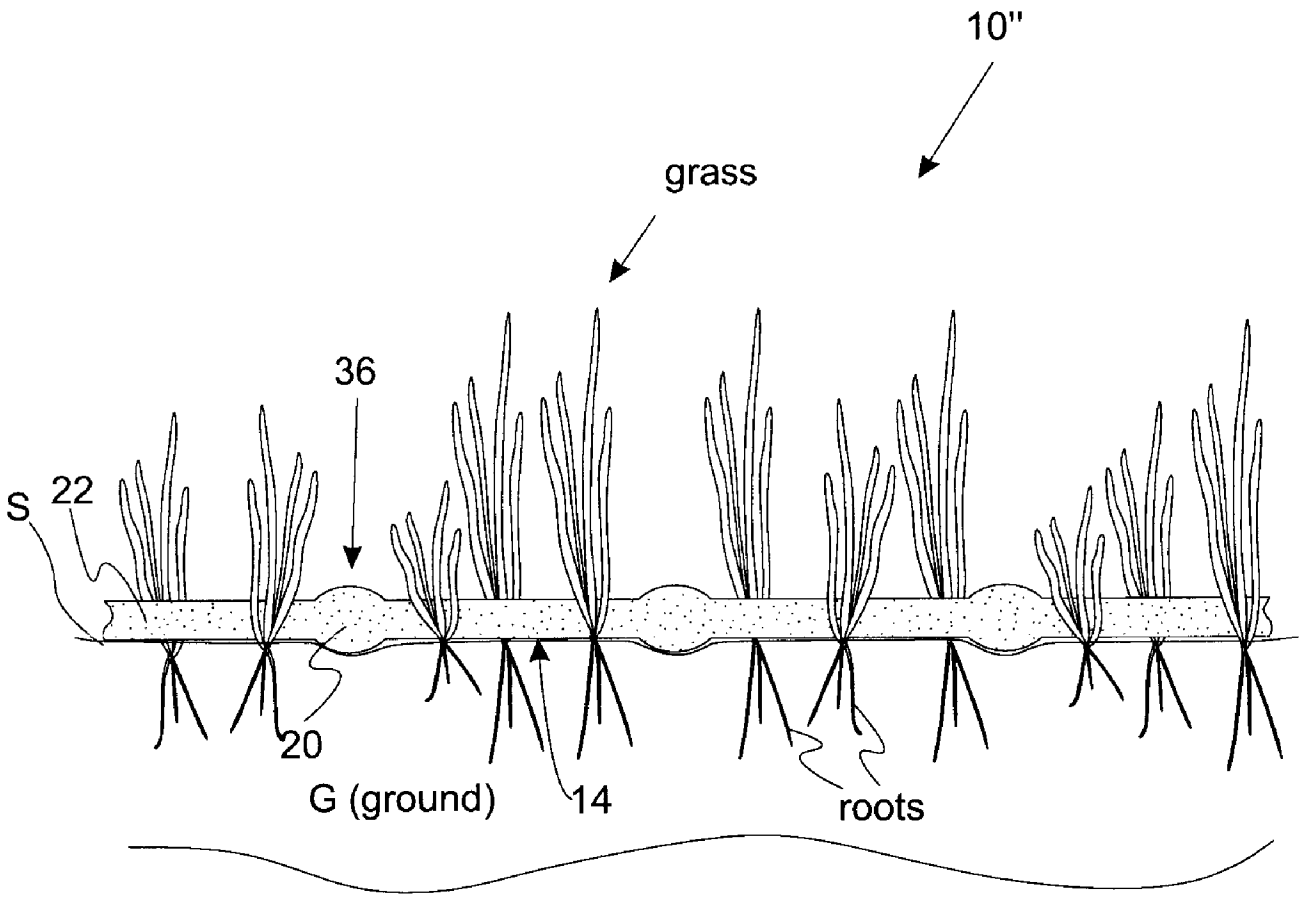
FIG. 5 is a side view of yet another embodiment of a terrain stabilization netting assembly of the present invention.

FIG. 5 illustrates the net 14 in a turf reinforcement application, where the net 14 allows grass seeds to germinate and grow while the roots intertwine with the net 14 to create a reinforced uniform structure. In other embodiments, the net 14 could be rolled around large rolls of turf to be used as turf wrap.

As can be seen in the embodiments illustrated in the FIGS. 1 and 3, the top net 14 and the bottom net 16 have substantially the same structure. However, it should be understood that the structural configuration and/or the composition and make-up of the top and bottom nets 14 and 16 may vary. For instance, bottom net 16 may have relatively smaller and/or different shape openings than top net 14. Notwithstanding, since in a particular practical embodiment having two nets, such as that illustrated in FIGS. 1 and 3, the nets 14 and 16 have the same structure, from hereon out, the configuration of top net 14 will be discussed only, with the understanding that the discussion applies equally to the bottom net 16.

Figure 2:
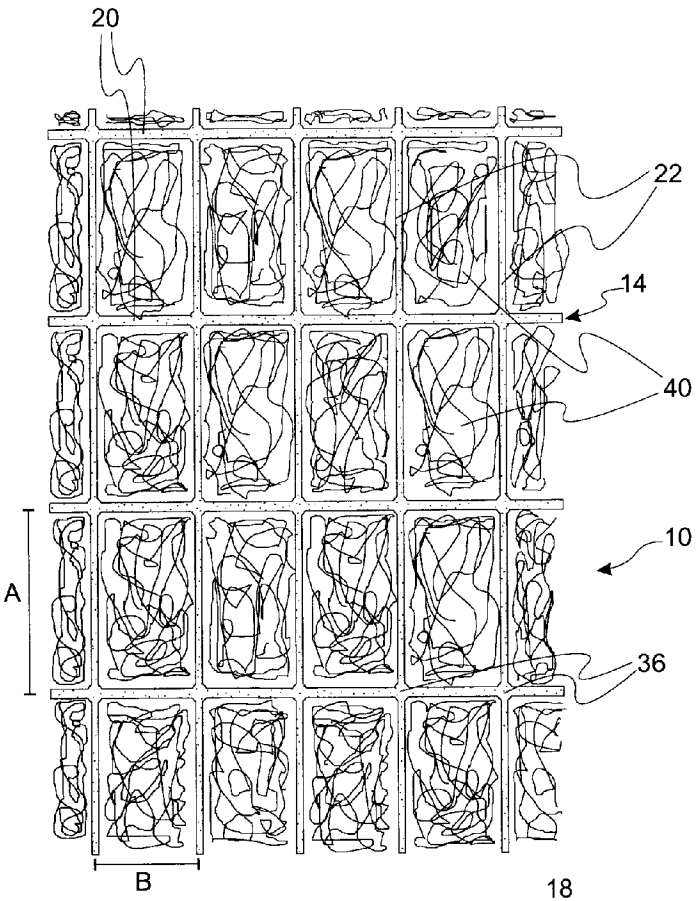
FIG. 2 is a top view of the erosion control netting assembly of FIG. 1.
Figure 6:
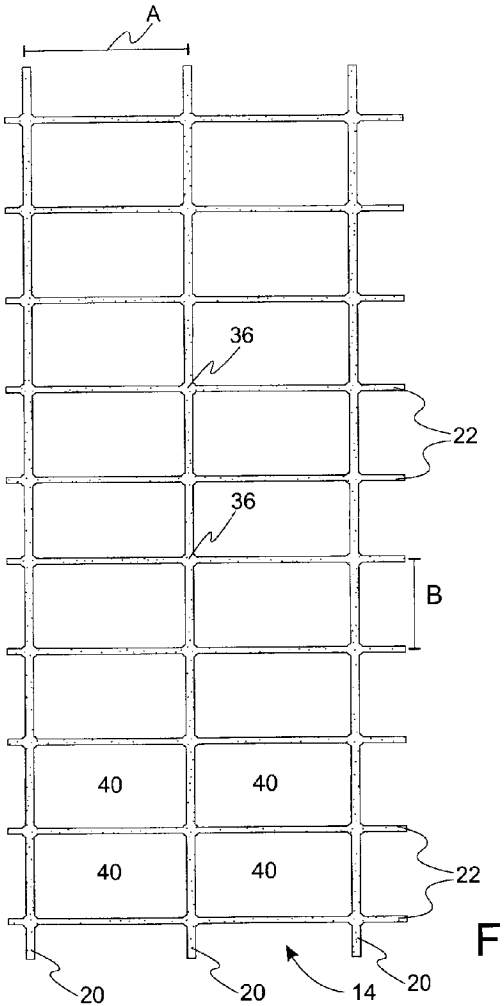
FIG. 6 is a top view of an exemplary component useable with the netting assemblies of FIGS. 1-5.

In the illustrated embodiment, as can best be seen in FIGS. 1, 2, and 6, the top net 14 comprises strands 20 extending in a first direction and strands 22 extending in a second, generally crosswise or transverse, direction. In at least one embodiment, the first direction is the machine direction, however, it should be understood that the orientation could be reversed such that the first direction is the transverse direction and the second direction is the machine direction.

When the erosion control netting assembly 10 is applied to the top surfaces S of a ground G, the strands 20 will generally extend down the slope of the ground surface and the strands 22 comprise horizontal members will generally run across the slope of the ground surface. The strands 20 and 22 cross at intersections 36 forming openings 40. The openings 40 of the net 14 are sufficiently sized to enable small animals to traverse and/or weave through the openings of the net without getting trapped in the openings. In the embodiment illustrated in FIGS. 1, 2, and 6, the openings 40 have rectangular shapes. It should be understood, however, that the openings 40 can have any suitable shape, such as square, as will be discussed in more detail below.

In at least one embodiment, the strands 20 and 22 are extruded polymeric elongate members which cross and intersect during extrusion to form the net 14. In at least one embodiment, the strands 20 and 22 are made of the same material. In other words, 100% of the strands are made of the same material.

In at least one embodiment, the strands 20 and 22 are made of any suitable polymeric material. In at least one embodiment, the strands 20 and 22 are made of a non-coated polymeric material. In at least certain embodiments, the polymeric material comprises a relatively durable, relatively high melting point material such as PP, PE, nylon, polyesters, and copolymers thereof. In yet other embodiments, the polymeric material comprises a degradable material. Certain examples of suitable polymeric materials can be found in published application Nos. 2005/0183329 and 2005/0217173, which are incorporated herein by reference.

In some embodiments, the strands 20 and 22 include a layer of lamination polymer, such as EVA, EMA, or other thermoplastic suitable for use as an adhesive, covering at least a portion of a polymeric material (i.e., PP or PE) of the core of the strand. In this embodiment, the layer of lamination polymer has a lower melting point than the polymeric material of the core of the strand 20 and/or 22 so that it melts during a lamination process to secure the net 14 to adjacent materials.

The polymeric material may include suitable additives, as are known in the art. Examples of suitable additives include, but are not necessarily limited to, colorant, heat stabilizers, photo (UV) light stabilizers, photo (UV) light degraders, degradation additives, and flame retardants.

In at least another embodiment, strands 20 are made of a different material than strands 22. In this embodiment, the net 14 may comprise 10 to 90 wt. % of the material comprising strands 20 and 90 to 10 wt. % of the material comprising strands 22. In other embodiments, the net 14 may comprise 35 to 65 wt. % of the material comprising strands 20 and 65 to 35 wt. % of the material comprising strands 22. In yet other embodiments, the net 14 may comprise 45 to 55 wt. % of the material comprising strands 20 and 55 to 45 wt. % of the material comprising strands 22. In this embodiment, strands 20 may be made of a relatively durable material, such as PP or PE, and strands 22 may be made of a lower melting point material, such as EVA, EMA or VLDPE, which can act as an adhesive for bonding the net 14 to the fibrous matrix 18. In yet other embodiments, strands 20 may be made of a lower melting point material, such as EVA, EMA or VLDPE, which can act as an adhesive for bonding the net 14 to the fibrous matrix 18, and strands 22 may be made of a relatively durable material, such as PP or PE.

The strands 20 and 22 of the net 14 are configured, or engineered, to result in openings 40 sufficiently sized to enable small animals to traverse and/or weave through the erosion control netting assembly 10 without getting trapped in the openings 40 of the net 14.

In at least one embodiment, the holes/openings 40 of the nets 14 depending upon the hole configuration, i.e., generally rectangular versus generally square, have a first direction mesh size (FDMS) A to second direction mesh size (SDMS) B ratio (FDMS/SDMS) of at least 2.5 or a first direction mesh size (FDMS) and a second direction mesh size (SDMS) of at least 2.4 inches per strand. As can best be seen in FIGS. 2, 6 and 7, the first direction mesh size (FDMS) A is the distance between center lines of adjacent strands 20 and the second direction mesh size (SDMS) B is the distance between center lines of adjacent strands 22.

In at least a first embodiment, as best illustrated in FIGS. 1, 2, and 6, the net 14 has holes/openings 40 having a generally rectangular shape. In at least this embodiment, the first direction members 20 have a strand count per inch (FDSC) that is less than the strand count per inch (SDSC) of the second direction members 22. In at least certain embodiments, when the net 14 has rectangular holes 40, the net has a SDSC/FDSC of at least 2.5, in another embodiment of 3 to 15, in yet other embodiments of 3.5 to 9, and in still yet another embodiments of 4.5 to 8. The FDSC is the number of strands per inch of strands 20 of net 14 and the SDSC is the number of strands per inch of strands 22 of net 14.

In at least one embodiment, when the holes or openings 40 are generally rectangular in shape, as best shown in FIGS. 1, 2, 5 and 6, the openings 40 of the net 14 have a first direction mesh size (FDMS) A to second direction mesh size (SDMS) B ratio (FDMS/SDMS) of at least 2.5, in another embodiment of 3 to 15, in yet other embodiments of 3.5 to 9, and in still yet another embodiments of 4.5 to 8.

In at least one embodiment, when the holes or openings 40 are generally rectangular in shape, as best shown in FIGS. 1, 2, and 6, the net 14 has a first direction strand count (FDSC) of less than 1 strands/inch and a second direction strand count (SDSC) of greater than 2 strands/inch, in other embodiments a first direction strand count (FDSC) of less than 0.75 strands/inch and a second direction strand count (SDSC) of greater than 2.5 strands/inch, and in yet other embodiments, a first direction strand count (FDSC) of less than 0.6 strands/inch and a second direction strand count (SDSC) of greater than 3 strands/inch.

In at least one embodiment, when the holes 40 are generally rectangular in shape, the net 14 has a FDSC of 0.1 to 1.3 strands/inch, in another embodiment of 0.16 to 0.80 strands/inch, and in yet another embodiment of 0.33 to 0.70 strands/inch.

In at least one embodiment, when the holes 40 are generally rectangular in shape, the net 14 has a SDSC of 0.5 to 10 strands/inch, in other embodiments of 1 to 7.5 strands/inch, and in yet other embodiments of 2 to 5 strands/inch.

In at least one embodiment, when the holes 40 are generally rectangular in shape, the net 14 has a FDMS of 0.75 to 10 inches/strand, in other embodiments of 1.25 to 6.25 inches/strand, and in yet other embodiments of 1.4 to 3 inches/strand. In at least one embodiment, when the holes 40 are generally rectangular in shape, the net 14 has a SDMS of 0.1 to 2.0 inches/strand, in other embodiments of 0.13 to 1.0 inches/strand, and in yet other embodiments of 0.2 to 0.5 inches/strand.

Figure 7:
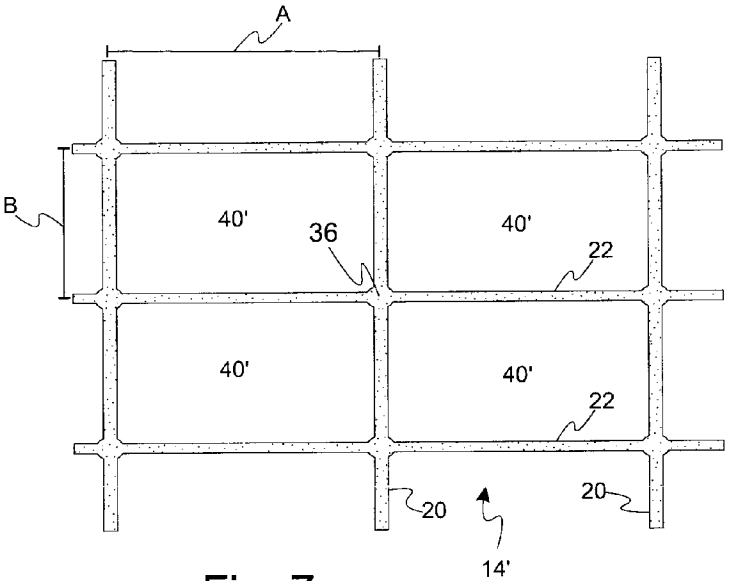
FIG. 7 is a top view of another exemplary component useable with the terrain stabilization netting assemblies of FIGS. 1-5.

FIG. 7 shows another embodiment of net 14' where the configuration of the strands 20 and 22 result in relatively large generally square-shaped holes 40'. In at least certain embodiments, these holes are large enough that an animal will not likely become trapped. Such a net 14' can be used within the erosion control assemblies 10, 10', 10" illustrated in FIGS. 3, 4 and 5. In this embodiment, while the FDSC may still be less than the SDSC, the FDSC and SDSC are relatively close in number and may be substantially equal or even equal. In at least one embodiment when the holes 40' are relatively square in shape, the net 14' has a FDMS/SDMS ratio of 0.5 to 2.0, in other embodiments of 0.6 to 1.6, and in yet other embodiments of 0.8 to 1.25.

In at least one embodiment, when the holes 40' are generally square in shape, the net 14' has a first direction mesh size (FDMS) and a second direction mesh size of (SDMS) of greater than or equal to 2.4 inches per strand, in other embodiments of 2.4 to 7.5 inches per strand, and in yet other embodiments of 3 to 6.5 inches per strand.

In at least one embodiment, the net 14' has a FDSC and a SDSC of less than 0.42 strands/inch, in at least another embodiment of 0.13 to 0.33 strands/inch, and in still yet another embodiment of 0.15 to 0.31 strands/inch.

In other embodiments where the holes 40' are relatively square, the holes have an FDMS (first direction mesh size) to SDMS (second direction mesh size) ratio of 0.5 to 2, in other embodiments of 0.6 to 1.6, and in yet other embodiments of 0.8 to 1.25.

In at least one embodiment, the extruded nettings 14 and 14' can be made by any suitable reciprocating netting extrusion process. In at least another embodiment, the extruded nettings 14 and 14' can be made by any suitable rotary extrusion process, where the netting is bias cut, forming machine direction and cross direction strands. In at least one embodiment, the extruded netting is then uniaxially oriented (i.e., oriented in only one direction) by any suitable uniaxial orienting process. In another embodiment, the extruded netting is then biaxially oriented (i.e., oriented in both directions) by any suitable biaxial orienting process. Suitable examples of these processes are well known.

Generally, suitable methods for making the nettings 14 and 14' comprise extruding the polymeric material through dies with reciprocating parts to form the general netting configuration. This creates machine direction strands 20 that cross the transverse direction strands 22, which flow continuously. After the extrusion, the netting is then typically stretched in both the machine direction, using a speed differential between two sets of nip rollers, and then stretched in the cross-direction, using a tentor frame. In at least one embodiment, the draft ratio is between 2.5 to 6.0 and in at least yet another embodiment between 3 and 4. In at least one embodiment, the tentor ratio is between 4 and 8, and in at least yet another embodiment between 4.5 and 7. It should be understood, that the above described method is just one of many suitable methods that can be employed to manufacture reciprocating extruded nettings 14 and 14' in accordance with the present invention.

In at least certain embodiments, the extruded netting 14 have FD strands 20 that have an average thickness of 0.001 to 0.10 inches, in other embodiments 0.005 to 0.04 inches, and in yet other embodiments 0.007 to 0.02 inches.

In at least certain embodiments, the extruded netting 14' have FD strands 20 that have an average thickness of 0.001 to 0.10 inches, in other embodiments 0.005 to 0.04 inches, and in yet other embodiments 0.007 to 0.026 inches.

In at least certain embodiments, the extruded netting 14 have SD strands 22 that have an average thickness of 0.001 to 0.10 inches, in other embodiments 0.0015 to 0.05 inches, and in yet other embodiments 0.002 to 0.020 inches.

In at least certain embodiments, the extruded netting 14' have SD strands 22 that have an average thickness of 0.001 to 0.10 inches, in other embodiments 0.005 to 0.04 inches, and in yet other embodiments 0.007 to 0.026 inches.

In at least certain embodiments, the extruded netting 14 have FD strands 20 that have an average width of 0.003 to 0.07 inches, in other embodiments 0.007 to 0.04 inches, and in yet other embodiments 0.01 to 0.035 inches.

In at least certain embodiments, the extruded netting 14' have FD strands 20 that have an average width of 0.003 to 0.07 inches, in other embodiments 0.007 to 0.05 inches, and in yet other embodiments 0.015 to 0.045 inches.

In at least certain embodiments, the extruded netting 14 have SD strands 22 that have an average width of 0.002 to 0.075 inches, in other embodiments 0.002 to 0.04 inches, and in yet other embodiments 0.0025 to 0.01 inches.

In at least certain embodiments, the extruded netting 14' have SD strands 22 that have an average width of 0.002 to 0.075 inches, in other embodiments 0.005 to 0.04 inches, and in yet other embodiments 0.01 to 0.035 inches.

In at least certain embodiments, the extruded netting 14 have joints 36 that have an average joint thickness of 0.005 to 0.1 inches, in other embodiments 0.01 to 0.06 inches, and in yet other embodiments 0.015 to 0.04 inches.

In at least certain embodiments, the extruded netting 14' have joints 36 that have an average joint thickness of 0.005 to 0.10 inches, in other embodiments 0.010 to 0.070 inches, and in yet other embodiments 0.015 to 0.065 inches.

The joints 36, as can been from the figures, are integral between the strands 20 and 22. In at least certain embodiments, the integral joints 36 help to provide stable nettings 14 and 14' which provide structure to the erosion control netting assemblies 10, 10' and 10", and can enhance soil stabilization, while reducing the potential to trap animals.

The present invention may be further appreciated by consideration of the following, non-limiting examples, and certain benefits of the present invention may be further appreciated by the examples set forth below.

EXAMPLE

Samples A-F are manufactured in standard reciprocating dies having the characteristics listed in Table 1. Samples A & D are made of a biodegradable material comprising PLA and polyester and samples B, C, E and F are made of a PP-based material.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An erosion control netting assembly comprising:

a first extruded plastic net;

a second extruded plastic net secured to the first net; and a fiber matrix disposed between the nets, wherein each of the first and second nets comprises:

a plurality of generally first direction members spaced apart from each other and a plurality of generally second direction members spaced apart from each other and attached to the generally first direction members to form joints at the intersections of the generally first direction members and the generally second direction members, the first direction members having a first strand count/inch (FDSC) and the second direction members having a second strand count/inch (SDSC), greater than or substantially equal to the first strand count/inch, with adjacent generally first direction members and intersecting adjacent generally second direction members cooperating to form openings in the first net that are engineered, or sufficiently sized, to enable small animals to traverse or weave through the erosion control netting assembly without getting trapped in the openings, the (FDSC)/(SDSC) being no more than 0.4.

2. The netting assembly of claim 1, wherein the nets have a first direction mesh size (FDMS) to second direction mesh size (SDMS) ratio (FDMS/SDMS) of at least 2.5 or a first

TABLE 1

Product Data from Test Sheets or Physical Testing

| Example | Product Weight PMSF - lbs. per 1,000 ft$^2$) | Strand Count (strand per inch) MD (MDSC) | Strand Count (strand per inch) TD (TDSC) | Strand Count Ratios MDSC/TDSC | Strand Count Ratios TDSC/MDSC | Mesh Size (inches per strand) MD (MDMS) | Mesh Size (inches per strand) TD (TDMS) | Mesh Size Ratios MDMS/TDMS | Mesh Size Ratios TDMS/MDMS |
|---|---|---|---|---|---|---|---|---|---|
| A | 2.50 | 0.28 | 0.26 | 1.08 | 0.93 | 3.57 | 3.85 | 0.93 | 1.08 |
| B | 1.50 | 0.28 | 0.25 | 1.12 | 0.89 | 3.57 | 4.00 | 0.89 | 1.12 |
| C | 1.50 | 0.55 | 4.00 | 0.14 | 7.27 | 1.82 | 0.25 | 7.27 | 0.14 |
| D | 2.50 | 0.55 | 4.00 | 0.14 | 7.27 | 1.82 | 0.25 | 7.27 | 0.14 |
| E | 1.50 | 0.76 | 3.0 | 0.25 | 3.95 | 1.32 | 0.33 | 4.0 | 0.25 |
| F | 1.90 | 0.76 | 3.0 | 0.25 | 3.95 | 1.32 | 0.33 | 4.0 | 0.25 |

| | Product Strength (lbf/3 in) | | Strand Dimensions | | | | |
|---|---|---|---|---|---|---|---|
| Example | MD | TD | MD Width (in) | TD Width (in.) | MD Thickness (in.) | TD Thickness (in.) | Joint Thickness (in.) |
| A | 13.50 | 5.49 | 0.0280 | 0.0375 | 0.0186 | 0.0139 | 0.0446 |
| B | 12.26 | 12.75 | 0.0184 | 0.0366 | 0.0153 | 0.0111 | 0.0583 |
| C | 11.80 | 25.80 | 0.0154 | 0.0048 | 0.0123 | 0.0030 | 0.0249 |
| D | 7.92 | 6.48 | 0.0260 | 0.0045 | 0.0161 | 0.0045 | 0.0258 |
| E | 12.90 | 17.0 | 0.0152 | 0.0053 | 0.0136 | 0.0054 | 0.020 |
| F | 15.0 | 21.0 | 0.0152 | 0.0095 | 0.0142 | 0.0065 | 0.030 |

direction mesh size (FDMS) and a second direction mesh size (SDMS) of at least 2.4 inches per strand.

3. The netting assembly of claim 2, wherein the nets have FDMS/SDMS ratio of 3 to 15.

4. The netting assembly of claim 3, wherein the nets have a FDMS/SDMS ratio of at least 3.5 to 9 and the second strand count is greater than the first strand count.

5. The netting assembly of claim 2, wherein the nets have a first direction strand count (FDSC) of less than 1.3 strands/inch and a second direction strand count (SDSC) of greater than 0.5 strands/inch.

6. The netting assembly of claim 2, wherein the nets have a FDSC of less than 0.42 strands/inch and a FDMS/SDMS ratio of less than 2.5.

7. The netting assembly of claim 2, wherein the nets have a first direction mesh size and a second direction mesh size of 2.4 to 7.5 inches per strand.

8. The netting assembly of claim 7, wherein the nets have a first direction mesh size and a second direction mesh size of 3.0 to 6.5 inches per strand.

9. The netting assembly of claim 6, wherein the nets have a FDSC and a SDSC of less than 0.42 strands/inch.

10. The netting assembly of claim 6, wherein the second stand count is substantially the same as the first strand count.

11. An extruded plastic net for use as in a terrain stabilization assembly, such as an erosion control netting, mulch stabilization netting, or a turf reinforcement netting, wherein the net is secured to, or staked or otherwise secured over, a fibrous matrix, fill material, mulch, seed, or turf, the net comprising:

a plurality of generally first direction members spaced apart from each other and a plurality of generally second direction members spaced apart from each other and attached to the generally first direction members to form joints at intersections of the generally first direction members and the generally second direction members, the first direction members having a first strand count/inch and the second direction members having a second strand count/inch, greater than or substantially equal to the first strand count/inch, with adjacent generally first direction members and intersecting adjacent generally second direction members cooperating to form openings in the net that are engineered, or sufficiently sized, to enable small animals to traverse or weave through the net without getting trapped in the openings, wherein the net has a first direction mesh size (FDMS) to second direction mesh size (SDMS) ratio (FDMS/SDMS) of at least 2.5 or a first direction mesh size (FDMS) and a second direction mesh size (SDMS) of at least 2.4 inches per strand.

12. The net of claim 11, wherein the net is made of polypropylene and has a FDMS/SDMS ratio of 3 to 15.

13. The net of claim 11, wherein the net has a FDMS/SDMS ratio of at least 3.5 to 9.

14. The net of claim 11, wherein the net has a first direction strand count (FDSC) of less than 1 strands/inch and a second direction strand count (SDSC) of greater than 2 strands/inch.

15. The net of claim 11, wherein the net has a FDSC of less than 0.42 strands/inch and a FDMS/SDMS ratio of less than 2.5.

16. The net of claim 11, wherein the net has a first direction mesh size and a second direction mesh size of 2.4 to 7.5 inches per strand.

17. The net of claim 11, wherein the net has a first direction mesh size and a second direction mesh size of 3.0 to 6.5 inches per strand.

18. The net of claim 11, wherein the net has a FDSC and a SDSC of less than 0.42 strands/inch.

19. An erosion control netting assembly comprising:

a first extruded plastic net; and a fiber matrix secured to the net, wherein the net comprises:

a plurality of generally first direction members spaced apart from each other and a plurality of generally second direction members spaced apart from each other and attached to the generally first direction members to form joints at the intersections of the generally first direction members and the generally second direction members to form openings having a first direction mesh size (FDMS) to second direction mesh size (SDMS) ratio (FDMS/SDMS) of at least 2.5 or a first direction mesh size (FDMS) and a second direction mesh size (SDMS) of at least 2.4 inches per strand, wherein the first direction members having a first strand count/inch and the second direction members having a second strand count/inch, greater than or substantially equal to the first strand count/inch, wherein the first direction members comprise extruded members formed in the machine direction and the second direction members comprise extruded members formed in generally the traverse direction to the machine direction.

20. The netting assembly of claim 19, wherein the net has a FDMS/SDMS ratio of 3 to 15.

21. The netting assembly of claim 19, wherein the net has a first direction mesh size and a second direction mesh size of 2.4 to 7.5 inches per strand.

22. The netting assembly of claim 19 further comprising a second net disposed on an opposite side of the matrix, the second net having a different generally strand configuration than the first net.

23. An erosion control netting assembly comprising:

a first extruded plastic net;

a second extruded plastic net spaced from and optionally secured to the first net; and a fiber matrix disposed between the nets, wherein at least one of the nets comprises:

a plurality of generally first direction members spaced apart from each other and a plurality of generally second direction members spaced apart from each other and attached to the generally first direction members to form joints at the intersections of the generally first direction members and the generally second direction members to form openings having a first direction mesh size (FDMS) to second direction mesh size (SDMS) ratio (FDMS/SDMS) of at least 2.5 or a first direction mesh size (FDMS) and a second direction mesh size (SDMS) of at least 2.4 inches per strand, wherein the first direction members having a first strand count/inch and the second direction members having a second strand count/inch, greater than or substantially equal to the first strand count/inch, wherein the first direction members comprise extruded members formed in the machine direction and the second direction members comprise extruded members formed in generally the traverse direction to the machine direction.

24. The netting assembly of claim 23, wherein the first and second nets do not have the same mesh size, strand count, or product configuration.

25. The netting assembly of claim 11 wherein the first and second members have an average thickness of 0.001 to 0.10 inches.

26. The netting assembly of claim 1 wherein the first direction members comprise extruded members formed in the machine direction and the second direction members comprise extruded members formed generally in the traverse direction to the machine direction.

27. The netting assembly of claim 11 wherein the first direction members comprise extruded members formed in the machine direction and the second direction members comprise extruded members formed generally in the traverse direction to the machine direction.

* * * * *